United States Patent [19]

Steiner

[11] 4,375,614

[45] Mar. 1, 1983

[54] VOLTAGE REGULATOR FOR DIRECT CURRENT POWER SUPPLY

[75] Inventor: William G. Steiner, Marietta, Ga.

[73] Assignee: Lockheed Corporation, Burbank, Calif.

[21] Appl. No.: 251,306

[22] Filed: Apr. 6, 1981

Related U.S. Application Data

[62] Division of Ser. No. 96,030, Nov. 20, 1979, Pat. No. 4,291,404.

[51] Int. Cl.[3] ..... G05F 1/56

[52] U.S. Cl. ..... 323/280; 323/901

[58] Field of Search ..... 323/273, 279, 280, 281, 323/349, 901; 307/592, 360, 597, 363; 330/261

[56] References Cited

U.S. PATENT DOCUMENTS

| | | | |
|---|---|---|---|
| 3,201,680 | 8/1965 | Ross et al. | 323/279 |
| 3,549,983 | 12/1970 | Sprogis | 323/273 |
| 3,831,081 | 8/1974 | Weiss | 323/349 |

OTHER PUBLICATIONS

Wireless World, vol. 82, No. 1485, pp. 83–84, May 1976.
Electronic Engineering, vol. 51, No. 626, p. 24, Aug. 1979.

*Primary Examiner*—William H. Beha, Jr.
*Attorney, Agent, or Firm*—John J. Sullivan

[57] ABSTRACT

A power supply (17) having a regulator featuring a series pass transistor (150) connected as a common collector amplifier is shown. The power supply is turned on and off by switching devices (11, 151, 160, 159) which control base current only to a transistor switch (155, 170) operating analog circuitry (157) which controls the pass transistor. Microcomputer control (181) of the power supply and self latching embodiments are also shown. The power supply shown herein can successfully regulate output voltages which differ from the raw DC input by no more than the saturation voltages of series pass transistor.

8 Claims, 6 Drawing Figures

VOLTAGE REGULATOR FOR DIRECT CURRENT POWER SUPPLY

This application is a division of application Ser. No. 96,030, filed Nov. 20, 1979, now U.S. Pat. No. 4,291,404, issued Sept. 22, 1981.

TECHNICAL FIELD

The present invention relates to circuit testing devices and more particularly to portable digital logic testing apparatus with a programmable interface between unit under test and testing apparatus so that a plurality of different circuits may be tested.

BACKGROUND OF THE INVENTION

The present invention relates to a portable circuit tester. In recent years there has been a virtual explosion in the market for integrated circuit electronics, both analog and digital. In many applications where high precision and a tolerance of extreme environmental conditions are required, hybrid integrated circuits are also popular.

Today there are hundreds of standard integrated circuits available all of which fit in one of several standard socket configurations. The most widely known configuration being a standard dual-in-line (DIP) socket for circuits having between four and sixteen pins. More recently twenty-four pin and forty pin dual-in-line configurations having wider spacing between the rows of sockets have become popular in the field of large scale integrated circuits (LSI).

It is been desirable to have an automatic testing apparatus for circuitry provided by a manufacturer as a quality control tool.

As greater and greater circuit density has been obtained in the field of integrated circuits, together with the ability to fabricate circuits on relatively large chips, the field of large scale integrated circuits has provided extremely complex functions available in standard integrated circuit (IC) packages. Many modern integrated circuits contain such complex functions that it is impractical to manually manipulate equipment to sequentially test various inputs and outputs in order to ascertain whether the circuit is operating properly. This increases the need for automated equipment which can take advantage of the inherent speed associated with the integrated circuit and perform a test of all possible inputs in a short period of time.

The proliferation of the use of integrated circuits in consumer products has created a need for a portable testing device for complex integrated circuits. It is becoming more and more difficult for maintenance personnel to ascertain when a particular integrated circuit in a device has failed. This is particularly true in apparatus where an integrated circuit may fail during a particular step of a sequential set of functions but the failure will not be apparent during steady state conditions under which the maintenance personnel may be performing tests.

Examples of previous automatic test equipment which includes programmable test routines are shown in U.S. Pat. No. 3,764,995 to Helf et al.; U.S. Pat. No. 3,622,876 to Ure et al.; and U.S. Pat. No. 4,053,844 to Hamaoui.

A portable programmed circuit tester is shown in U.S. Pat. No. 4,108,358 to Niemaszyk et al. This device includes a central processing unit and a program for executing a plurality of tests for different circuits.

A disadvantage of devices such as those shown in the Niemaszyk et al. patent is that such a device is large and impractical for use in field maintenance work.

Heretofore it has not been known in the art how to miniaturize a device such as that shown in the Niemaszyk et al. patent and to make same operate from a storage battery in a practical manner which allows use of the device in the field.

SUMMARY OF THE INVENTION

The present invention provides a miniaturized hand-held battery operated apparatus using a minimal number of components.

It is a further object of the present invention to provide a portable battery operated apparatus which may be constructed from a one chip microcomputer and a plurality of standard input/output (IO) multiport devices.

It is a further object of the present invention to provide a unique power supply whereby standard nickle-cadmium batteries may be used to power circuits under test.

It is a further object of the present invention to provide a portable hand-held battery operated apparatus having a power supply that is controlled by a central processing unit.

It is still a further object of the present invention to provide a battery operated portable logic circuit tester controlled by an integrated circuit microcomputer microprocessor wherein power to the external load and memory devices external to the processor containing instructions for procedures is not supplied until the beginning of the cycle, thereby prolonging battery life and eliminating damage to the external load.

It is a further object of the present invention to provide an improved power supply for battery operated devices which includes a series pass transistor controlled by a shunt derived bias current wherein power regulation may be maintained down to the saturation point of the pass transistor.

These and other objects of the present invention will become apparent from the detailed description below.

DETAILED DESCRIPTION

Figure 1:
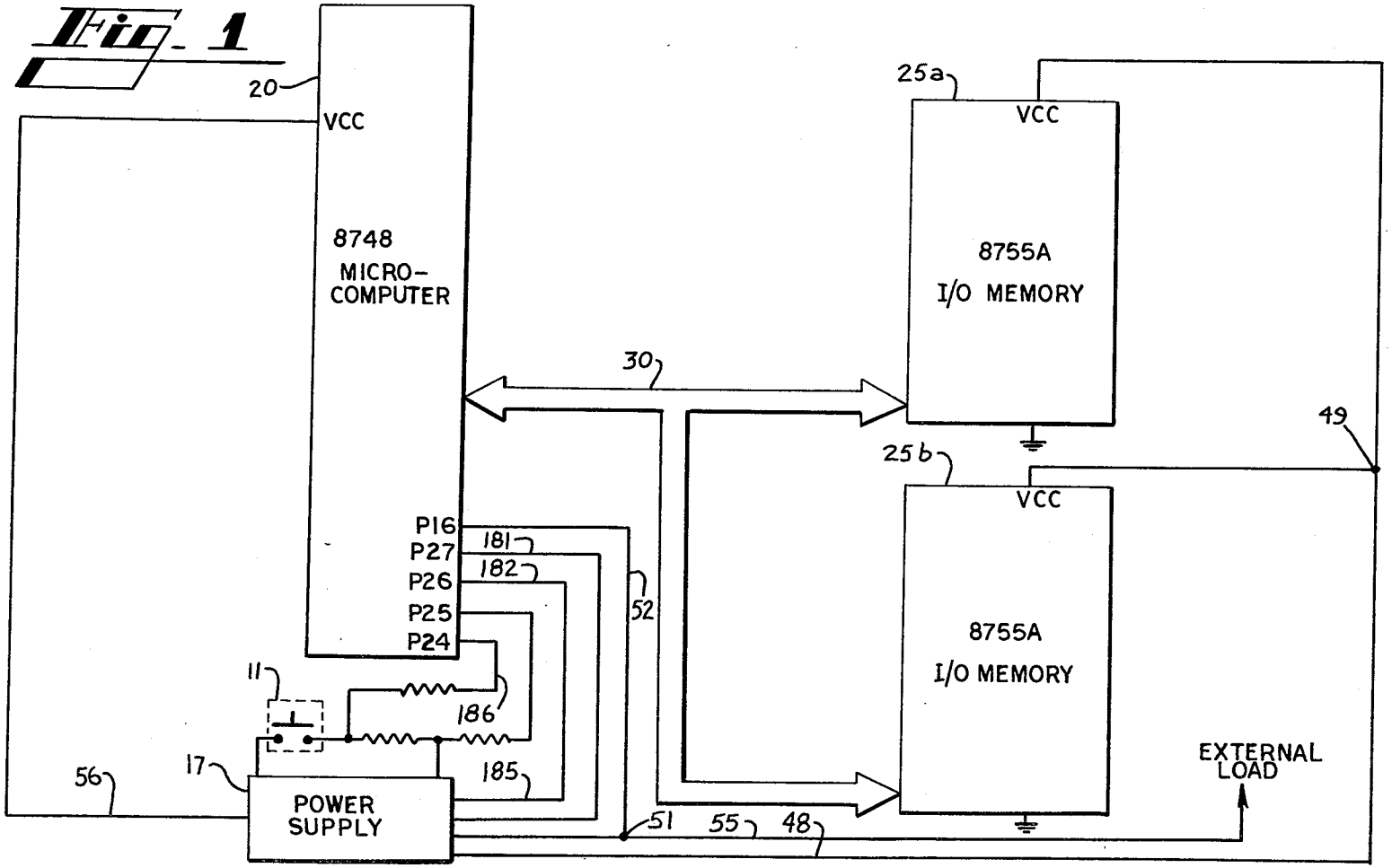
FIG. 1 is a partially schematic, partially block diagram of the preferred embodiment of the present invention.

Turning to FIG. 1, the preferred embodiment of the present invention may be seen in greater detail. In the preferred embodiment of the present invention microcomputer 20 is embodied as a type 8748 eight bit one chip microcomputer currently manufactured by Intel Corporation of Santa Clara, Calif. It will be appreciated by those skilled in the art that detailed descriptions of the functioning of the 8748 microcomputer are available from the manufacturer, that sufficient detail will be presented herein to enable one skilled in the art to understand how the microcomputer works in the present invention, and how other microcomputers could be used to construct an embodiment of this invention.

The type 8748 microcomputer includes 1K of eight bit erasable programmable read only memory (EPROM). It will be appreciated by those skilled in the art that a type 8048 microcomputer could be used in the mass production of the preferred embodiment of the present invention since the type 8048 includes a masked programmable read only memory.

I/O/memory is embodied as two integrated circuits 25*a* and 25*b* shown in FIG. 1. Each of these circuits is an 8755A EPROM with I/O currently manufactured by Intel Corporation of Santa Clara, Calif. From the description of the 8755A follow, it will be apparent to those skilled in the art how other similar combinations of read only memory and I/O ports may be used to construct an embodiment of the present invention. As will be described in greater detail hereinbelow, power is supplied only under certain specified conditions under the control of microcomputer 20 thus minimizing the drain on the battery of power supply 17.

The outputs of power supply 17 appear on lines 48, 55, and 56. Line 56 supplies power to microcomputer 20. Line 48 supplies power to chips 25*a* and 25*b* where it is tapped at point 49. Line 55 from power supply 17 supplies power to the external load. The novel power supply 17 which will be described in detail in conjunction with FIGS. 2 and 3 and the manner in which said power supply is controlled by microcomputer 20 in the preferred embodiment will now be described.

THE POWER SUPPLY OF THE PRESENT INVENTION

Figure 2:
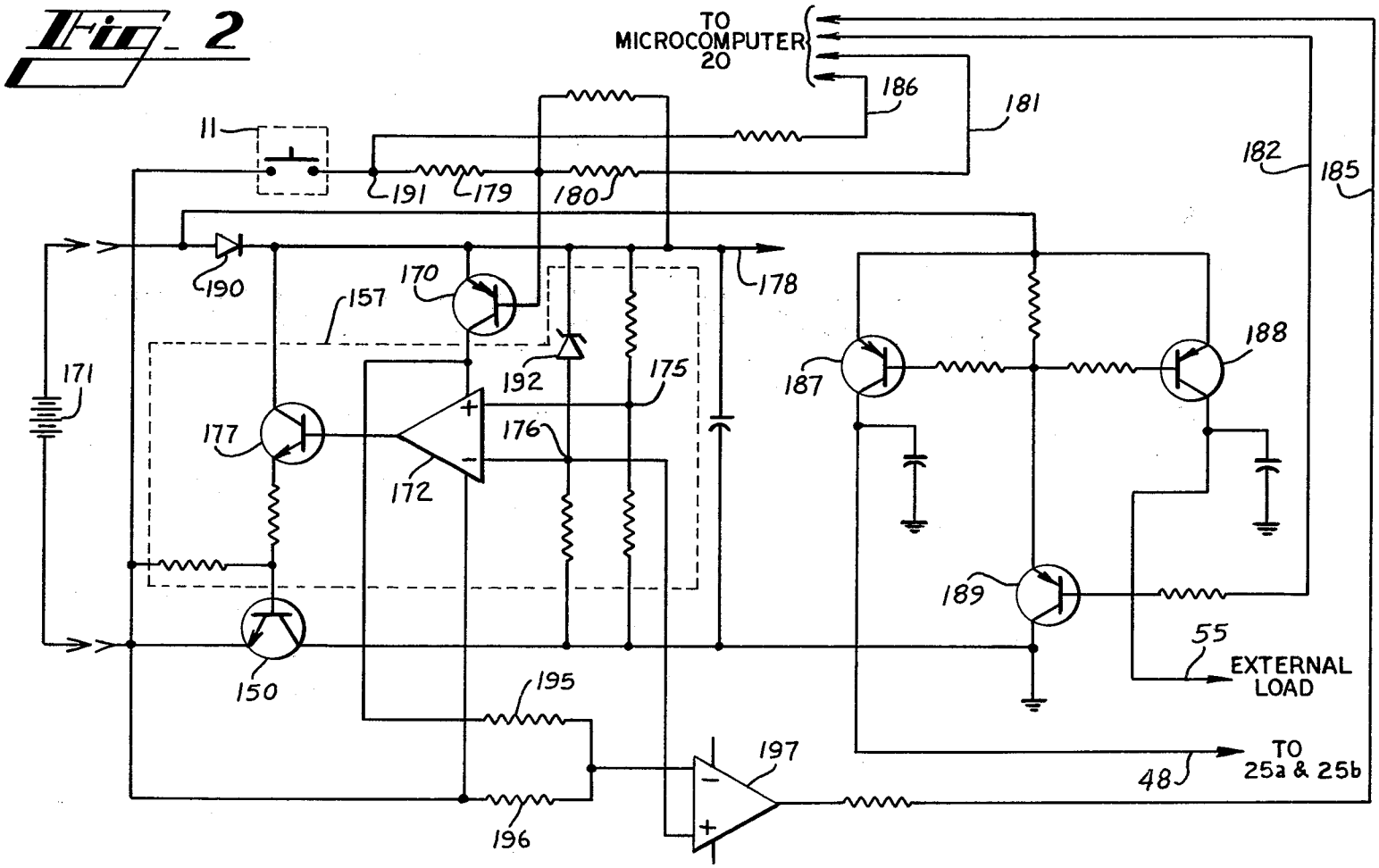
FIG. 2 is a schematic diagram of the novel power supply of the present invention.

The present invention also provides a unique power supply which is particularly suited but whose usefulness is not limited to battery operated portable devices. FIG. 2 is a schematic of the preferred embodiment of the novel power supply used in the preferred embodiment of the present invention.

Figure 3B:
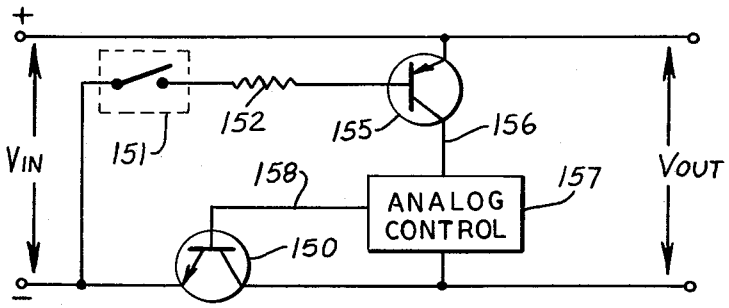
FIGS. 3A–3D show a conventional power supply regulator and three embodiments of the novel regulator of the present invention.
Figure 3A:
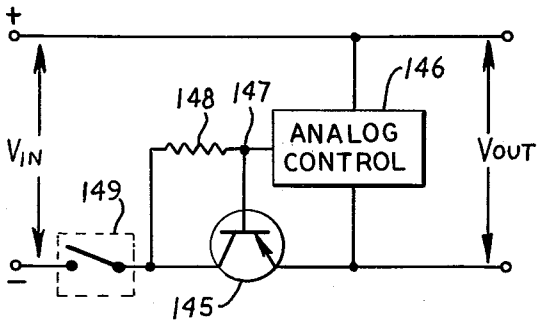

FIG. 3A shows a conventional power supply using a series regulator pass transistor 145. Generalized analog circuitry shown as 146 generates a signal at point 147, the base of transistor 145. When switch 149 is turned on, base current is supplied to transistor 145 through resistor 148. As is known to those skilled in the art, a conventional voltage regulator using a series pass transistor such as that shown in FIG. 3A is a species of an emitter follower amplifier. Such regulators have several drawbacks which do not affect the improved supply of the present invention. Conventional regulators require a minimum differential of approximately two volts between the input voltage (Vin) and the output voltage (Vout). This represents in the case of low voltage battery operated portable equipment a rather significant fraction of the power supplied by the battery.

The second disadvantage of conventional regulators is the fact that the on-off switch for the system such as switch 149 shown in FIG. 3A must have the capacity to carry the entire load current plus current going to bias the regulator. While this is not usually a significant problem in battery operated portable equipment, it increases the cost of equipment using higher currents.

The minimum voltage differential between the output and the input voltages for conventional series regulated power supplies impresses limitations on the types of batteries which may be used in a given piece of equipment. Particularly the use of nickel-cadmium batteries may be precluded in the case in which it is necessary to maintain a battery output voltage of 7 volts or more. In such a case, the user of the equipment may be forced to go to more expensive disposable batteries rather than be able to take the advantage of recharageable batteries such as those of nickel-cadmium construction.

FIG. 3B shows a conceptually simple representation of the improved power supply of the present invention. The power supply of FIG. 3B includes a series pass transistor 150, an on-off switch 151 in series with a resistor 152 going to the base of transistor 155 which supplies current along line 156 to the generalized analog control circuitry represented as 157. Analog control circuitry 157 provides base current along line 158 to transistor 150. The power supply of FIG. 3B has a raw DC input port labeled Vin and a regulated output port labeled Vout. The most striking unconventional feature of the regulator of FIG. 3B is the fact that pass transistor 150 is an NPN transistor but appears in the negative leg of the power supply. Note in FIG. 3A that a PNP pass transistor is in the negative leg of the power supply. As is well known to those skilled in the art, an equivalent circuit for FIG. 3A exists for which an NPN series pass transistor will appear in the positive leg of the power supply. It is also well known to those skilled in the art that a conventional series regulator such as that shown in FIG. 3A will not work at all if transistor 145 were to be replaced with a NPN transistor in the negative leg.

A second feature of the novel power supply of the present invention as shown in FIG. 3B is the fact that the on-off switch 151 only carries the base current to transistor 155 and does not have to have a current carrying capacity equal to all of the current supplied at the input voltage port. When switch 151 is closed base current is provided to transistor 155 through resistor 152. This turns on transistor 155 which allows current to flow through line 156 and allows generalized analog circuitry 157 to provide base drive through line 158 to transistor 150 thus operating the regulator. An advantage of the novel power supply of the present invention is that it may regulate the output voltage through a voltage differential between the input and the output voltage all the way down to the collector emitter saturation voltage for transistor 150.

It will be apparent to those skilled in the art that the opening of switch 151 removes all base drive from transistor 155 which prevents current from flowing along line 156 to analog control circuitry 157. This in turn removes base drive from transistor 150 turning off the regulator. Note that the entire power supply may be controlled by switch 151 which must carry only the base current for transistor 155. Thus, in high current applications an entire machine and regulator may be switched on and off by a switch carrying a much smaller current than that supplied at the input port. This is particularly true when it is considered that transistor 155 may be a relatively low current variety since it must only supply base drive to transistor 150 and enough current to properly operate analog control circuitry 157.

Before describing in detail an embodiment of analog circuitry 157 several advantageous and novel switching arrangements with the novel power supply of the present invention will be described.

Figure 3D:
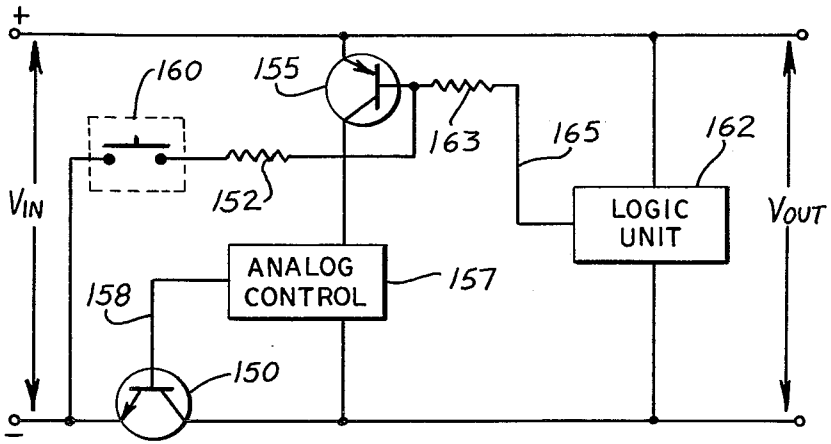
Figure 3C:
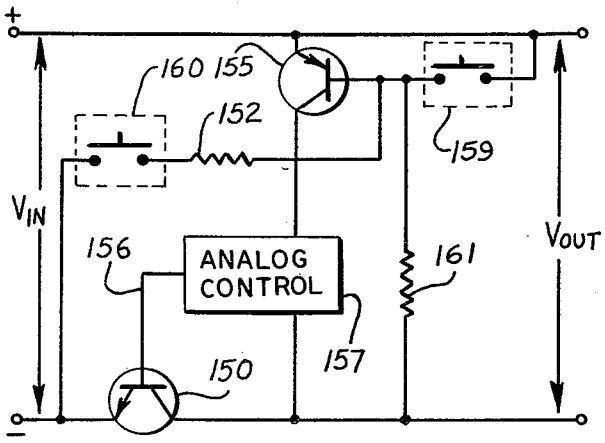

FIG. 3C shows an advantageous means for switching the power supply of the present invention on and off. This embodiment is controlled by a pair of pushbutton switches 160 and 159. Assume initially that the power supply and any load connected to the output port are off. Operation of switch 160 supplies base drive to transistor 155 through resistor 152. When transistor 155 turns on activating analog circuitry 157 and providing base drive to transistor 150, the circuit will remain on since transistor 155 may then be supplied with base drive current through resistor 161 on the output side of pass transistor 150.

Operation of switch 159 shorts the base-emitter junction of transistor 155 thus cutting it off. This terminates operation of analog control circuitry 157 removing base drive from pass transistor 150 so thus terminates the supply of base drive to transistor 155 through resistor 161. Thus the regulator and any load device will be cut off. Note in this case that switches 159 and 160 again must only be sufficient to carry the base current for transistor 155 or in the case of switch 159 the current provided through resistor 161 by the output voltage. Also these switches must only carry these currents momentarily. Thus it will be apparent that switches of much lower current rating than are required of conventional regulators may be used in the regulator of FIG. 3C. Note that resistor 161 provides a means for latching on the regulator which is connected to the output port of the regulator. The transistion from off to on is supplied via a temporary connection (switch 160) to the input port.

FIG. 3D shows yet another improvement which generically represents the power supply for the preferred embodiment of the present invention. Rather than having the off function controlled by a switch such as 159 of FIG. 3C, FIG. 3D shows a situation in which the regulator is used to supply regulated voltage to a powered logic unit 162. Logic unit 162 may be any apparatus which is powered by the output from the regulator. The logic unit is designed, as is the preferred embodiment, to provide a logical zero on line 165 upon the condition of being powered up, the logical zero at line 165 will provide a path for base drive through resistor 163 to transistor 155 just as in the case of resistor 161 providing base drive in the example of FIG. 3C.

Therefore if logic unit 162 maintains a logical zero on line 165 upon powering up, the logic unit may respond to any predetermined set of inputs or to raise the voltage on line 165 to a logical one thus shorting the base-emitter junction of transistor 155 cutting off the regulator. This of course cuts off the logic unit also and provides apparatus whereby an output having a current sinking capacity no greater than the base current required to keep transistor 155 on may be used to turn off both the logic unit and the regulator supplying it with power. All this is accomplished without the use of a relay or any other device capable of carrying the entire load current in addition to series regulator transistor 150 which much carry the load current in any conventional regulator. Logic unit 162 is generically a utilization circuit connected to the output port of the regulator.

With the general nature of the improved regulator of the present invention in mind, the preferred embodiment thereof used in the preferred embodiment of the present invention shown in FIG. 2 will now be described. As may be seen from FIG. 2 the block labeled 157 corresponds to analog control circuitry 157 of FIGS. 3B, 3C, and 3D. The operation of on/test switch 11 momentarily ties the base of transistor 170 to the negative terminal of battery 171 turning the transistor on. It may thus be appreciated that the base of transistor 170 is a control input to a means for controlling current to op amp 172 .

When transistor 170 turns on power is applied to low power operational amplifier 172. Intrinsic imbalances in amplifier 172 cause it to drive transistor 177 on. Operational amplifiers as a species have intrinsic imbalance which will cause them to provide a positive voltage at their outputs when their power supply is turned on. However an additional intrinsic imbalance may be created by placing a resistor and diode in series between points 176 and 191. The operation of transistor 177 supplies base drive to transistor 150 which turns on the entire regulator and thus provides power to the microcomputer 20. It is to be understood that the positive power supply lead of microcomputer 20 is connected to point 178.

It will be appreciated by those skilled in the art that the function of transistor 170 may be performed by other switching devices. Under such circumstances a properly biased terminal is the equivalent of the base of transistor 170 and serves as a control input.

Note that the base of transistor 170 is connected through resistor 180 to line 181 which in the preferred embodiment is provided to the P27 output of microcomputer 20 shown in FIG. 1. Part of the start up program for the operational system stored in the memory of microcomputer 20 is to hold pin P27 low thus providing base drive to transistor 170 which keeps amplifier 172 on. In the preferred embodiment of the present invention, amplifier 172 is embodied by one of the amplifiers in a type LM358 dual operational amplifier package currently manufactured by National Semiconductor Corporation of Santa Clara, Calif.

Transistors 187, 188 and 189 control the power supplied to I/O/memory chips **25*a* and 25*b* and the unit external load. This is accomplished when line 182 which is connected to output P26 of microcomputer 20 goes low. This event turns on transistor 189 which supplies base drive to transistors 187 and 188 supplying power to the external units along lines 48 and 55**.

Note that Schottky diode 190 has been provided in the positive leg of the power supply for the microcomputer to compensate for the drops which occur in transistors 187 and 188.

By use of the arrangement shown in FIG. 2, on/test switch 11 may also be used to input data to microcomputer 20. Line 186 which is connected to input P24 of microcomputer 20 senses the position of on/test switch 11. Operation of switch 11 takes point 191 low which may be sensed by microcomputer 20. Upon release of switch 11, point 191 is pulled up by resistor 179.

As may be seen from FIG. 2, amplifier 172 is responsive to the differential voltage between points 175 and 176. It will be apparent that the noninverting terminal connected to point 175 is at a fraction of the output voltage between regulator ground and point 178. Point 176 is maintained a constant potential with respect to point 178. This constant potential is the zener voltage of diode 192. In the preferred embodiment Vz is three volts. Therefore as the output voltage between ground and point 178 rises, point 175 becomes more negative with respect to point 176. This causes the output of amplifier 172 to fall tending to reduce the emitter current of transistor 177 which deprives transistor 150 of base drive thus increasing the collector-emitter voltage of transistor 150 and tending to lower the output voltage of the regulator.

The preferred embodiment of the present invention also includes an additional feature for ascertaining when battery voltage is low. Operational amplifier 197 is used to detect a low battery condition which will be signalled along line 185 to the P25 input of microcomputer 20. In the preferred embodiment, amplifier 197 is conveniently the other half of the type LM358 dual low power operational amplifier chip from which amplifier 172 is obtained. The noninverting input of amplifier 197 is connected to point 176. The inverting input of amplifier 197 is connected to a voltage divider which senses a fraction of the voltage between the collector of transistor 170 and the negative battery terminal. Therefore when the output voltage of battery 171 drops below a predetermined level, the output of amplifier 197 will swing negative pulling line 185 low. When this condition is sensed by microcomputer 20 a routine within the operating system is executed which alerts the user through display 16 that the device is preparing to turn off and then in fact turns the apparatus off.

It will be appreciated by those skilled in the art that other embodiments of the present invention may be constructed based on the disclosure herein with the foregoing description of the preferred embodiment has been by way of example. Therefore the scope of the present invention is to be limited only by the claims below.

I claim:

1. In a regulator for a direct current power supply including an input port for accepting raw direct current, an output port for providing a regulated output voltage, the improvement of:

a series pass transistor having its emitter terminal connected to said input port and its collector terminal connected to said output port; error signal means for providing input to said series pass transistor, said input being a function of the difference between said output voltage and a predetermined reference voltage; said error signal means comprising a differential amplifier including a pair of supply terminals, one of said supply terminals being connected to one side of said input port and the other of said pair of supply terminals being connected to one side of said output port; and a switching means for controlling current to said pair of supply terminals.

2. A regulator as recited in claim 1 wherein said switching means includes a control input and further comprising a switch for connecting said control input to one side of said input port.

3. In a regulator for a direct current power supply including an input port for accepting raw direct current, an output port for providing a regulated output voltage, the improvement of:

a series pass transistor having its emitter terminal connected to said input port and its collector terminal connected to said output port; error signal means for providing input to said series pass transistor, said input being a function of the difference between said output voltage and a predetermined reference voltage; said error signal means comprising a differential amplifier including a pair of supply terminals, one of said supply terminals being connected to one side of said input port and the other of said pair of supply terminals being connected to one side of said output port; and a transistor switch in series with said pair of supply terminals.

4. In a regulator for a direct current power supply including an input port for accepting raw direct current, an output port for providing a regulated output voltage, the improvement of:

a series pass transistor having its emitter terminal connected to said input port and its collector terminal connected to said output port; error signal means for providing input to said series pass transistor, said input being a function of the difference between said output voltage and a predetermined reference voltage; said error signal means comprising a differential amplifier including a pair of supply terminals, one of said supply terminals being connected to one side of said input port and the other of said pair of supply terminals being connected to one side of said output port.

5. A regulator as recited in claim 3 further comprising means for connecting the base of said transistor switch to a first side of said output port for biasing said transistor switch on;

selectively operable switch means for connecting said base of said transistor switch to a second side of said output port; and selectively operable switch means for connecting said base of said transistor switch to a first side of said input port.

6. Apparatus comprising the combination of:

a regulator for a direct current power supply including an input port for accepting raw direct current, an output port for providing a regulated output voltage, a series pass transistor;

error signal means for providing an input to said series pass transistor, said input being a function of the difference between said output voltage and a predetermined reference voltage; said error signal means comprising a differential amplifier including a pair of supply terminals, one terminal being connected to one side of said input port and the other of said pair of supply terminals being connected to one side of said output port;

a switching means including a control input, said switching means being connected in series with said pair of supply terminals;

switch means selectively operable for temporarily connecting said control input to one side of said input port;

a utilization circuit connected across said output port, said utilization circuit including a control output responsive to said output voltage being applied at said output port to provide a predetermined logical condition at said control output in response to the initialization of said output voltage;

means connecting said control input to said control output; and wherein said utilization circuit is responsive to at least one predetermined set of conditions to establish a second and opposite logic state at said control output.

7. Apparatus as recited in claim 6 wherein said switching means comprises a transistor switch.

8. Apparatus as recited in claim 7 wherein said control input comprises the base of said transistor switch.

* * * * *